US007048644B2

(12) United States Patent
Wang

(10) Patent No.: US 7,048,644 B2
(45) Date of Patent: May 23, 2006

(54) HAND GRIP

(75) Inventor: Min Chia Wang, Yong Kang (TW)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 10/881,267

(22) Filed: Jun. 30, 2004

(65) Prior Publication Data

US 2005/0020374 A1 Jan. 27, 2005

(30) Foreign Application Priority Data

Jul. 24, 2003 (TW) ..... 92213502 U

(51) Int. Cl.
*A63B 53/16* (2006.01)

(52) U.S. Cl. ..... 473/300

(58) Field of Classification Search ..... 473/300–303, 473/549–552, 568, 286; 16/DIG. 12, DIG. 18, 16/DIG. 19, 430; D8/DIG. 6–8; 74/551.9; 81/489, 492, 421; 280/821; D21/756, 721
See application file for complete search history.

(56) References Cited

U.S. PATENT DOCUMENTS 2,704,668 A * 3/1955 Park ..... 473/300
5,322,290 A * 6/1994 Minami ..... 473/201
RE34,767 E * 10/1994 Soong ..... 473/300
6,471,268 B1 * 10/2002 Stenstrom et al. ..... 294/15

* cited by examiner

*Primary Examiner*—Stephen Blau
(74) *Attorney, Agent, or Firm*—Daniel S. Kalka

(57) ABSTRACT

An improved hand grip 10 comprises a molded base structure 14 having a cap 16 and a body 18 for forming an inner layer 22 and an outer layer 24 molded on the body 18. The body 18 has an inner surface 26 with a plurality of radial grooves 28 spaced apart along the length of the body 18 in the form of groove clusters 30.

10 Claims, 5 Drawing Sheets

HAND GRIP

"This application claims priority of Taiwanese Patent Application No. 092213502, filed on Jul. 24, 2003".

BACKGROUND OF THE INVENTION

1. Field of the Invention

The present invention relates generally to an improved hand grip, and more particularly to a golf club grip designed to improve grip firmness and tactile grip feel, buffering effect, and vibration damping.

2. Description of the Related Art

Traditionally, a golf club grip is a one-piece structure of molded rubber with a smooth curved inner surface formed to tightly fit onto a golf club shaft. The rubber grip usually has a durometer value range of 50–60 on a Shore A scale. A rubber material with this durometer value does not provide the best comfort or tactile comfort. Also, it does not provide optimal vibration absorption or damping.

There still exists a need for a hand grip with improved grip feel and vibration damping. The improved hand grip would include an inner rubber layer with a higher durometer value than traditional molded rubber grips and an outer rubber layer with a lower durometer value than traditional grips to increase its firmness in gripping, tactile comfort, and buffering. In order to reduce vibration, the inner surface of the inner rubber layer would have a structure designed to reduce any direct transmission of vibration to the hands.

BRIEF SUMMARY OF THE INVENTION

Accordingly, an object of the present invention is to provide an improved hand grip.

Another object of the present invention is to provide an improved golf club grip.

Still another object of the present invention is to provide an improved golf club grip with better grip feel, grip firmness, vibration damping, and shock absorbing qualities.

The improved hand grip according to the present invention comprises a molded base structure forming an inner layer, and having an outer layer molded thereon, the inner layer has a higher durometer value than the outer layer and an inner surface of the inner layer has a plurality of radial grooves therein for facilitating vibration damping.

The various features of novelty which characterize the invention are pointed out with particularity in the claims annexed to and forming a part of this disclosure. For a better understanding of the invention, its operating advantages, and specific objects attained by its uses, reference is made to the accompanying examples, drawings, and descriptive matter in which a preferred embodiment of the invention is illustrated.

DETAILED DESCRIPTION OF THE INVENTION

The present invention resides in an improved hand grip for a hand tool or a sporting implement. While reference is made herein for describing in detail a golf club grip, it should be understood that the improved hand grip according to the present invention is equally applicable for use on a handle of a tool, like a hammer for example, or a sporting implement, like a tennis racquet, a badminton racquet, a racquetball racquet or the like.

Figure 1:
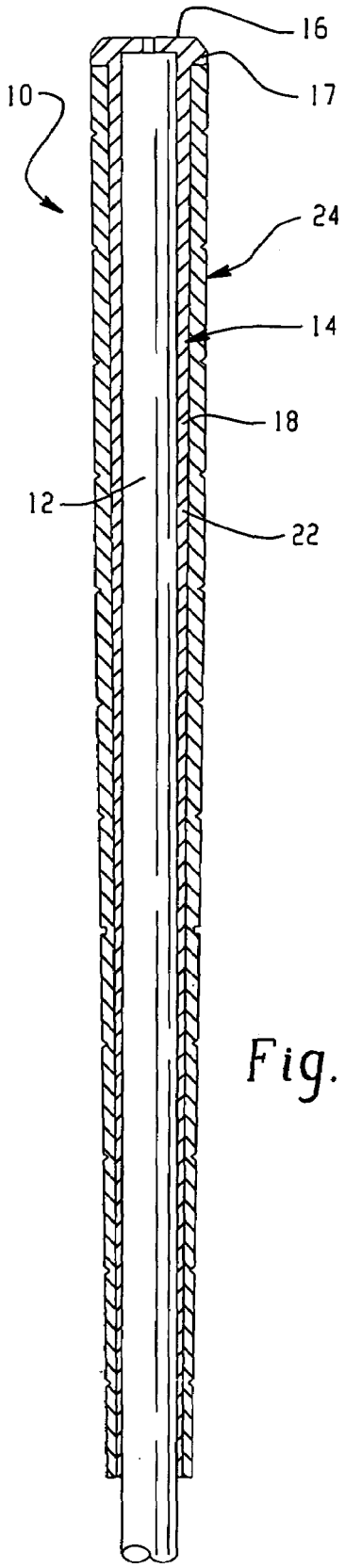
FIG. 1 is a sectional view of a golf club grip according to the present invention shown on a golf club shaft.

Referring first to FIG. 1, there is shown an improved hand grip generally designated 10 as a golf club grip on a golf club shaft 12 in accordance with the present invention. Grip 10 comprises a molded base structure 14 that includes an integrally formed cap 16 with a rim 17 and a body 18 that together form an inner layer 22 of the grip 10. The body 18 of the molded base structure 14 extends axially from the cap 16 downward to a set distance for a golf club grip as is known in the art. The body 18 is constructed to receive an outer layer 24.

The molded base structure 14 is preferably made of a rubber material and has a durometer value that is in the range of about 55 to about 75 on the Shore A scale. Molded base structure 14 may be formed by injection molding in a manner that is known in the art.

The outer layer 24 is molded onto the body 18 of the molded base structure 14 beginning from the rim 17 of the cap 16. The outer layer 24 has a durometer value in the range of 28–48 on the Shore A scale. The two layers 22, 24 are made of rubber.

Figure 2:
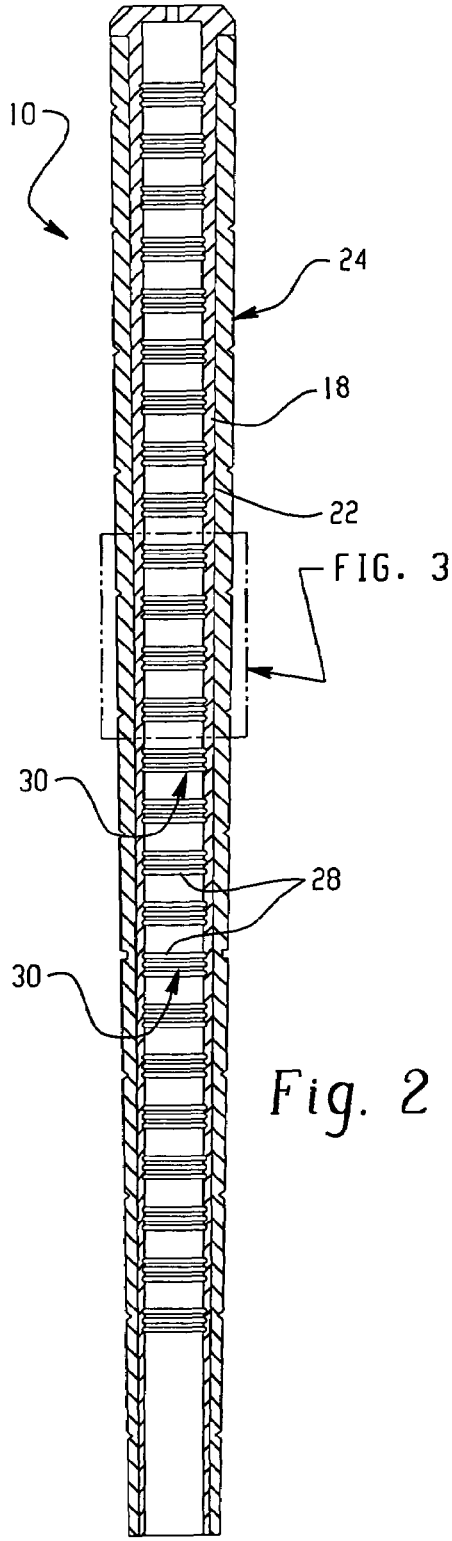
FIG. 2 is a sectional view of the golf club grip shown in FIG. 1.
Figure 3:
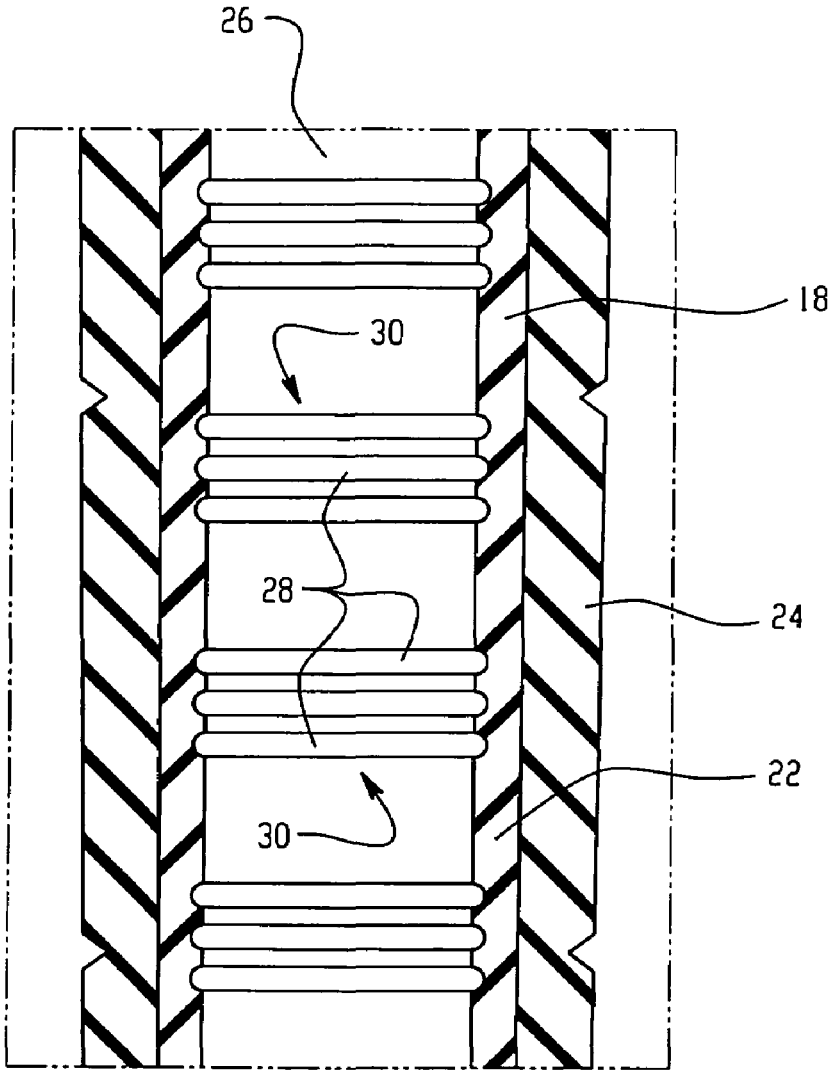
FIG. 3 is an enlarged sectional view of a portion of the grip shown in FIG. 2.

Referring next to FIGS. 2 and 3, an inner surface 26 of the body 18 has a plurality of radial grooves 28 therein with the grooves 28 being spaced apart to form groove clusters 30.

While a preferred embodiment of the present invention has been described above, it must be understood that the present invention is not intended to be limited thereto. The present invention advantageously provides the outer rubber layer 24 of the grip 10 with a durometer value in the range of about 28–48 on a Shore A scale to effectively increase the firmness of the grip 10 and the buffering effect of the grip. The inner rubber layer 22 with a durometer value in the range of about 55–75 on a Shore A scale and the plurality of grooves 28 enhance vibration damping.

Figure 4:
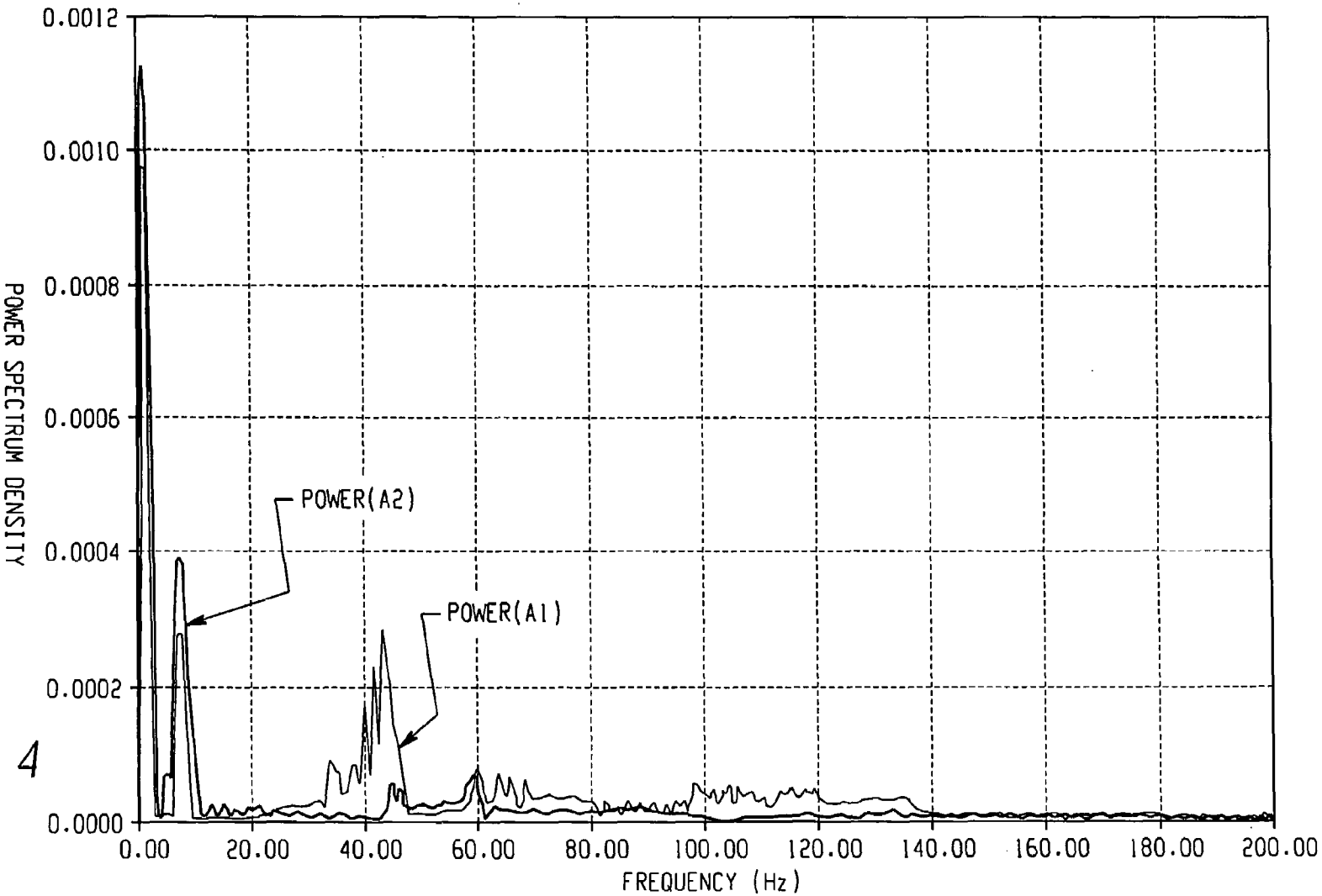
FIG. 4 is a graph comparing the Power Spectrum Density (PSD) values of a grip according to the present invention (A2) with a traditional molded rubber grip (A1).

Turning now to FIG. 4, the National Cheng Kung University Energy Research Center conducted vibration absorption tests on grip 10 according to the present invention (A2) versus a traditional molded rubber grip (A1). Realizing there is a difference in the way a golf club hits a ball each time, the vibration absorption efficiency in the tests is represented by the signal factor of the power spectrum density (PSD) measured with a dynamic signal analyzer, a HP 35670A analyzer. The vibration absorption efficiency is represented by the transfer function (TF) factor. The results are listed below in Table I, where the average PSD value is approximately −42.3% and the average TF value is approximately −55.8%. This data shows the significant improvement in vibration absorption with the grip according to the present invention over a traditional golf grip.

TABLE I

| Code No. | Calculation Formula | Vibration Absorption Efficiency PSD (%) | TF (%) |
|---|---|---|---|
| A2 | (A2 − A1)/A1 | −42.3% | −55.8% |

Figure 5:
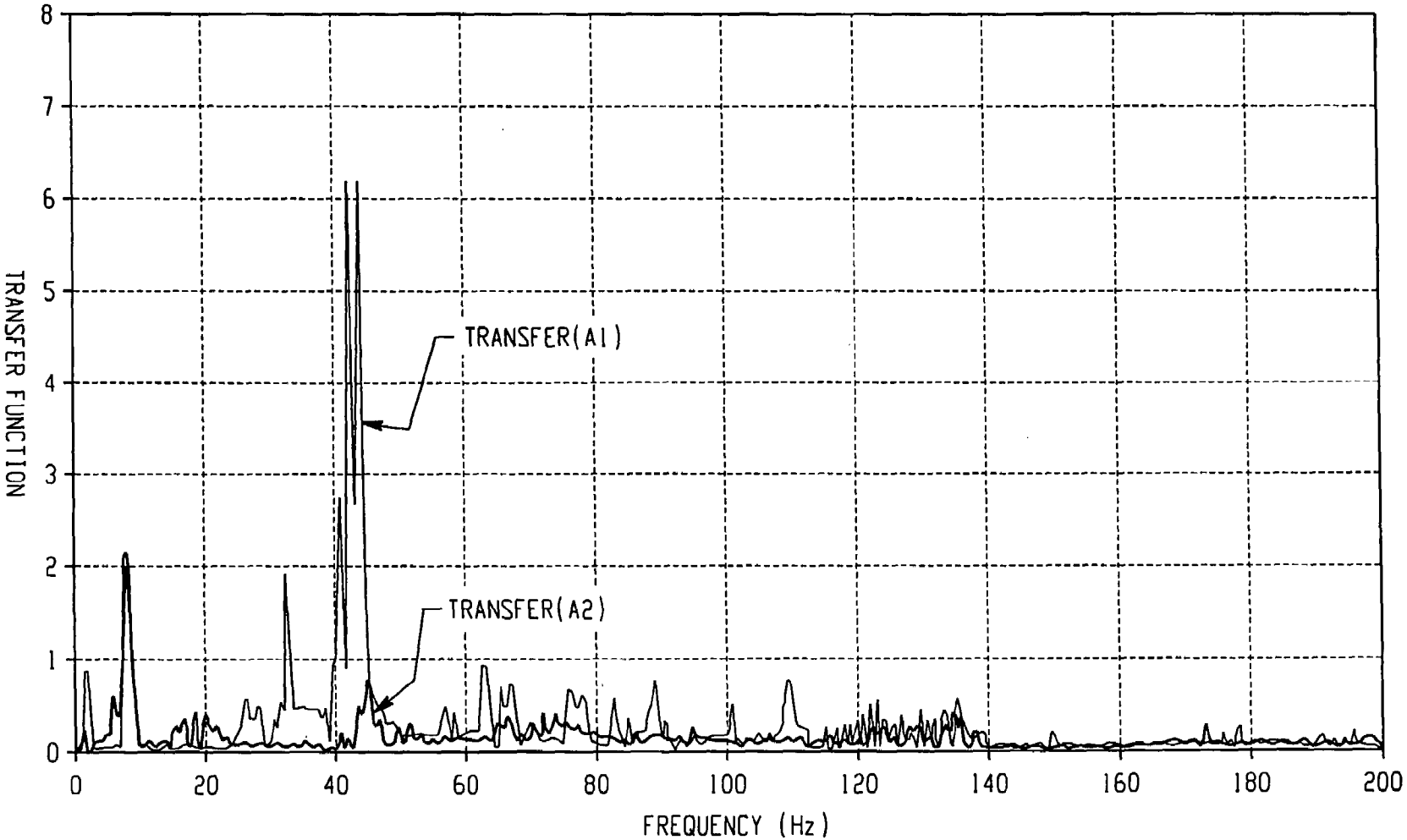
FIG. 5 is a graph comparing the Transfer Function (TF) values of a grip according to the present invention (A2) with a traditional molded rubber grip (A1).
Figure 6:
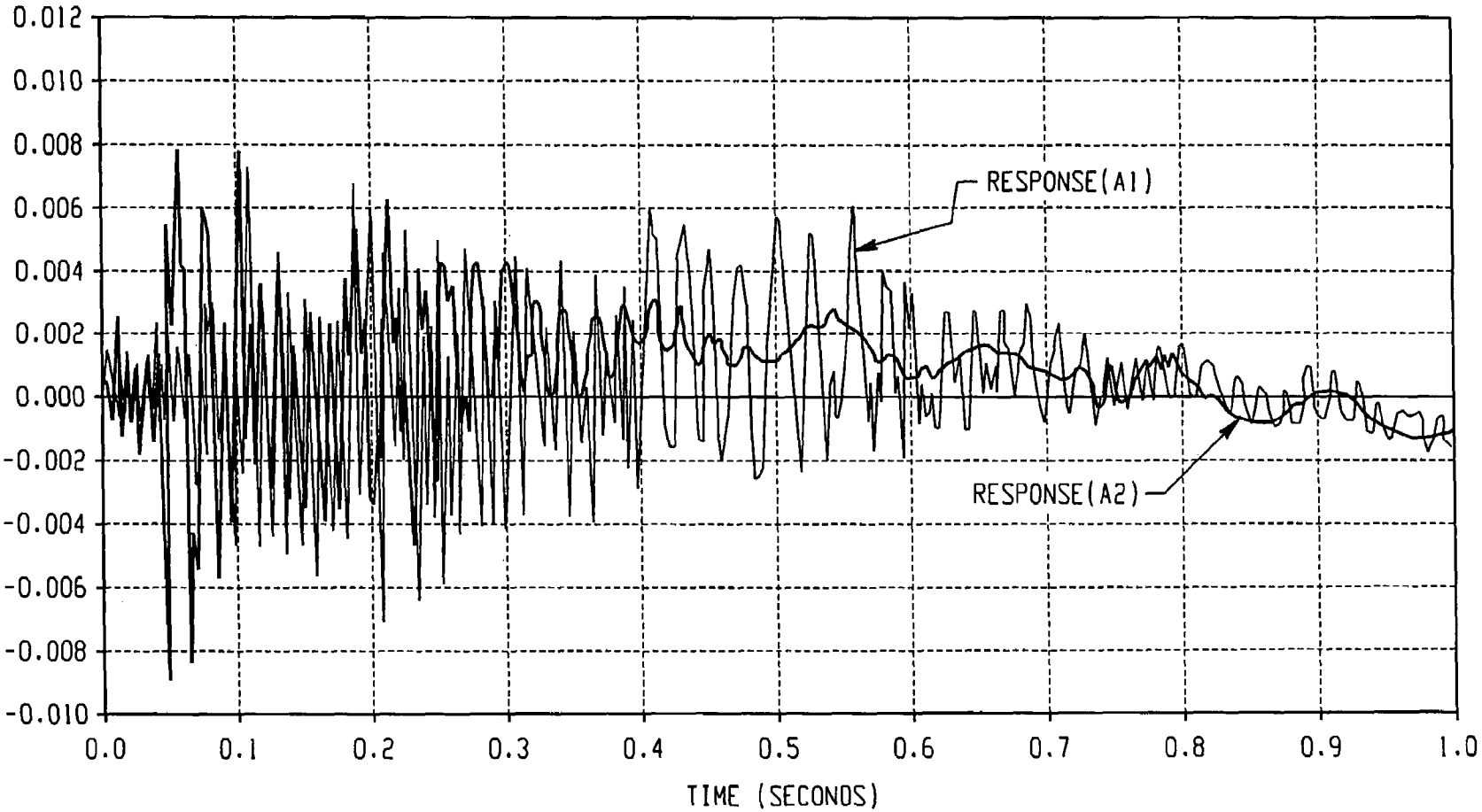
FIG. 6 is a graph comparing the Response values of a grip according to the present invention (A2) with a traditional molded rubber grip (A1).

Next referring to FIGS. 4–6, the power spectrum density, the transfer function, and the accelerator output are represented by "power", "transfer", and "response" respectively, as seen in FIGS. 4, 5, and 6. According to FIGS. 4 and 5, the vibration is believed to be felt most strongly at the frequency of 40 Hertz (Hz). The grip 10 according to the present invention (A2) again demonstrates superior vibration absorption efficiency over the traditional grip (A1). In FIG. 6, the vibration curve of the present invention (A2) begins to flatten out at around 0.5 seconds. Once again, this is strong evidence that the grip 10 according to the present invention has excellent vibration absorption efficiency.

The foregoing example and tests illustrate the advantages of the present invention over a single-layer structure of the traditional grip. The double-layer structure of an inner layer and an outer layer in accordance with the present invention includes not only the feature of the inner layer having a higher durometer value to increase the grip's tightness in fit onto the golf club shaft and the outer layer with a lower durometer value to improve the tactile comfort, grip firmness and grip buffering effect, but the plurality of radial grooves in the inner surface 26 of the inner layer 22 improves vibration absorption efficiency. Tests on the present invention have shown excellent results. The present invention has improved on the disadvantages of traditional grips and substantially improved the tactile quality of the grips at a competitive price.

The present invention has industrial applicability, novel features, and advanced characteristics. The foregoing example as it relates to a golf club grip is intended to only illustrate one of the applicable implementations of the invention, and, as such, it is not to be used to limit the implementation or scope of the present invention.

While specific embodiments of the invention have been shown and described in detail to illustrate the application of the principles of the invention, it will be understood that the invention may be embodied otherwise without departing from such principles.

I claim:

1. An improved hand grip, comprising a molded base structure having only one cap and a body for forming an inner layer comprising a rubber material, and an outer layer disposed on said body, said body having an inner surface with a plurality of radial grooves therein for facilitating vibration damping wherein said plurality of radial grooves on said inner surface of said body are spaced apart axially along a length of the grip at distances to form more than two groove clusters.

2. The improved hand grip according to claim 1, wherein said inner and outer layers comprise a rubber material.

3. The improved hand grip according to claim 1, wherein said inner layer has a durometer value in the range of about 55 to about 75 on a Shore A scale.

4. The improved hand grip according to claim 3, wherein said outer layer has a durometer value in the range of about 28 to about 48 on a Shore A scale.

5. The improved hand grip according to claim 4, wherein said inner and outer layers comprise a rubber material.

6. The improved hand grip according to claim 5, wherein said grip comprises a golf club grip.

7. The improved hand grip according to claim 1, wherein said plurality of radial grooves within a cluster on said inner surface of said body are spaced apart at equal distances on the grip.

8. In a molded golf club grip, the improvement comprising a plurality of radial grooves on an inner surface thereof for enhanced vibration damping wherein said plurality of radial grooves on said inner surface of said grip are spaced apart axially along a length of the grip at distances to form more than two groove clusters, wherein the material forming the inner surface comprises a rubber material, said grip is formed by an inner layer and an outer layer, and said grip has only one cap.

9. A method for making an improved hand grip, comprising the steps of:

providing a molded base structure having only one cap and a body for forming a first inner layer comprising a rubber material having a durometer value ranging from about 55 to about 75 on a Shore A scale;

providing a plurality of radial grooves on an inner surface of the body wherein said plurality of radial grooves on said inner surface of said body are spaced apart axially along a length of the grip at distances to form more than two groove clusters; and molding an outer layer on the body, the outer layer having a durometer value ranging from about 28 to about 48 on a Shore A scale.

10. A method as recited in claim 9, wherein the inner and outer layers are formed of a rubber material.

* * * * *